US009082335B2

(12) United States Patent
Susami

(10) Patent No.: US 9,082,335 B2
(45) Date of Patent: Jul. 14, 2015

(54) DISPLAY CONTROL APPARATUS

(71) Applicant: ROLAND CORPORATION, Shizuoka (JP)

(72) Inventor: Ryo Susami, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 353 days.

(21) Appl. No.: 13/710,471

(22) Filed: Dec. 11, 2012

(65) Prior Publication Data

US 2013/0162695 A1 Jun. 27, 2013

(30) Foreign Application Priority Data

Dec. 21, 2011 (JP) ..... 2011-279981

(51) Int. Cl.

| | |
|---|---|
| ***G09G 5/00*** | (2006.01) |
| ***G09G 5/10*** | (2006.01) |
| ***G09G 3/32*** | (2006.01) |
| ***G10H 1/00*** | (2006.01) |

(52) U.S. Cl.

CPC .. *G09G 5/10* (2013.01); *G09G 3/32* (2013.01); *G09G 5/00* (2013.01); *G10H 1/00* (2013.01)

(58) Field of Classification Search

None

See application file for complete search history.

(56) References Cited

U.S. PATENT DOCUMENTS 4,492,917 A * 1/1985 Inami et al. ..... 324/76.16
5,127,056 A * 6/1992 Storaasli ..... 704/276

FOREIGN PATENT DOCUMENTS

| | | |
|---|---|---|
| JP | H5-15279 | 3/1993 |
| JP | H6-55194 | 7/1994 |
| JP | 2002-116761 | 4/2002 |
| JP | 2004-029720 | 1/2004 |

* cited by examiner

*Primary Examiner* — Amare Mengistu
*Assistant Examiner* — Joseph G Rodriguez
(74) *Attorney, Agent, or Firm* — Jianq Chyun IP Office

(57) ABSTRACT

A display control apparatus is provided. Every time when the level of the signal is obtained, the peak display with respect to the level of the signal is initiated by the first peak display control unit in a predetermined display manner in the display position obtained by the peak position obtaining unit. On the other hand, the previous peak displays being displayed according to the level of the signal obtained at a previous time and a time before the previous time is continued, and the display manner of the previous peak display being displayed is changed according to the second peak display control unit. Accordingly, while one and more than one level are simultaneously displayed on one display device, the temporal sequence of the levels, which is simultaneously displayed with different display manners, can be recognized by the user.

20 Claims, 9 Drawing Sheets

13a
| segment number 13a1 | brightness information 13a2 | striking time 13a3 |
|---|---|---|
| 10 | | |
| 9 | | |
| 8 | | |
| 7 | | |
| 6 | | |
| 5 | | |
| 4 | 100 | ts1 |
| 3 | | |
| 2 | | |
| 1 | | |
FIG. 3A
13a
| segment number 13a1 | brightness information 13a2 | striking time 13a3 |
|---|---|---|
| 10 | | |
| 9 | | |
| 8 | 100 | ts2 |
| 7 | | |
| 6 | | |
| 5 | | |
| 4 | 60 | ts1 |
| 3 | | |
| 2 | | |
| 1 | | |
FIG. 3B
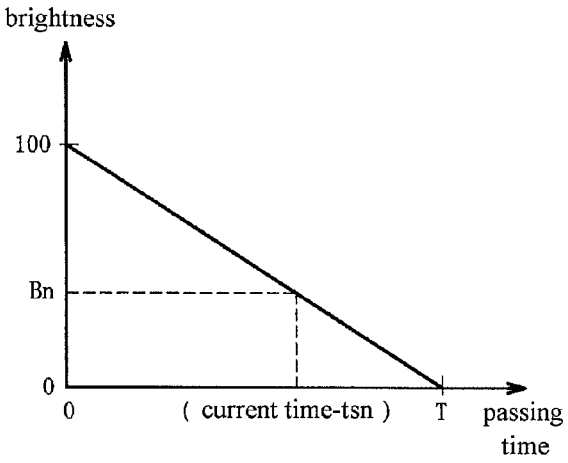
FIG. 3C
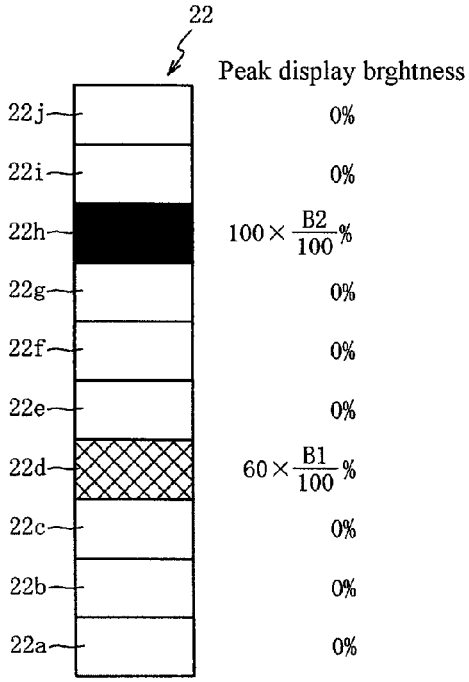
FIG. 3D

DISPLAY CONTROL APPARATUS

CROSS-REFERENCE TO RELATED APPLICATION

This application claims the priority benefit of Japan application no. 2011-279981, filed on Dec. 21, 2011. The entirety of the above-mentioned patent application is hereby incorporated by reference herein and made a part of specification.

BACKGROUND OF THE INVENTION

1. Field of the Invention

The present invention generally relates to a display control apparatus, and more particularly, to a display control apparatus capable of simultaneously displaying a plurality of levels on one display device and temporal sequence of the levels simultaneously displayed can be suitably recognized by a user.

2. Description of Related Art

An electronic musical instrument having a touch display device to display the touch strength of the key in a bar graph form is disclosed in Japanese Patent No. H05-15279. According to such electronic musical instrument, when a plurality of keys are pressed, the strength of the touch corresponding to one representing key of the keys being detected in the last event, for example, is displayed by the touch display device.

However, in the electronic musical instrument disclosed in Japanese Patent No. H05-15279, the user cannot obtain the information about the touch strength which is omitted to be displayed. In addition, the user can just visually observe the condition of one level changing over time. Accordingly, the user is hard to recognize the temporal sequence of the level variation such as compared to the previous level how much the level of this time changes.

On the other hand, for instance, in the level meter in which a plurality of light emitting diodes (LED) is arranged, following the small level if the large level is generated, by inverting (switching off) the peak of LED of the relative smaller level, a plurality of levels is displayed on one display device. However, also in this case, the user is hard to recognize the temporal sequence of the level variation such as among the plurality of levels which one is the latest level. Moreover, in this case, a decrease of the level display sensation resulted from the switching off of a part of the LEDs occurs.

SUMMARY OF THE INVENTION

Accordingly, in order to solve the above problems, the present invention is directed to provide a display control apparatus capable of simultaneously displaying a plurality of levels on one display device and the temporal sequence of the levels simultaneously displayed can be recognized by a user.

The present invention is directed to provide a display control apparatus that controls a level display device including a plurality of display positions arranged in a predetermined order corresponding to the increasing signal levels. Specifically, every time when a level of a signal is obtained, the peak display corresponding to the level of the signal (signal of this time) is initiated by the first peak display control unit in a predetermined display manner in the display position obtained by the peak position obtaining unit. On the other hand, while continuing previous peak display being displayed according to the level of the signal obtained at a previous time, wherein the previous time includes an immediately previous time and a time or times before the immediately previous time, and the display manner of the previous peak display being displayed is changed according to the second peak display control unit. As a result, the display manner of the previous peak display being displayed with respect to the level of the signal obtained at a previous time can be different from the display manner of the current peak display with respect to the level obtained this time. As a result, while a plurality of levels is simultaneously displayed on one display device, the temporal sequence of the levels simultaneously displayed can be recognized by the user with different display manners. Moreover, the previous peak display being displayed with respect to the level obtained at a previous time can be continued (remains to be displayed). As a result, the peak display that should be displayed will not disappear and the decrease of level display sensation may be prevented.

According to an exemplary embodiment of the present invention, according to the passing time period (passing time counted from when the level of the signal is obtained by the level obtaining unit) obtained by the passing time obtaining unit the display manner of the previous peak display displayed in the display position displaying the peak display is changed by the third peak display control unit. Accordingly, the previous peak display is faded out as time passes by. Accordingly, the previous peak display can be switched off after a predetermined time without causing discomfort.

According to an exemplary embodiment of the present invention, the change of the display manner of the previous peak display being displayed is the decrease of the display brightness of the previous peak display being displayed. As a result, it can be easy to instinctively recognize the temporal sequence of the level.

According to an exemplary embodiment of the present invention, when the level of the signal is obtained by the level obtaining unit, a first display range comprising one or more display positions of the plurality of display positions corresponding to the level obtained by the level obtaining unit is determined by the first level display range determining unit. In addition, the first display range determined by the first level display range determining unit is then determined by a second level display range determining unit through changing the level to be smaller as time passes by. In other words, after the level obtaining unit obtains the level of the signal, the decay of the obtained level as time passes can be shown through the display range determined by the first or second level display range determining unit. Moreover, the level display control unit displays, at the brightness of the level display, the display position included in the display range determined by the first or second level display range determining unit with the display brightness of the previous peak display controlled by the first, the second or the third peak display control unit being lower than the display brightness of the level display. Or, the level display control unit displays, at the brightness of the level display, the display position included in the display range determined by the first or second level display range determining unit at which the peak display is not performed by the first, the second or the third peak display control unit. Herein, the display brightness for level display is set to be a predetermined brightness lower than at least the display brightness when the peak display is initiated. As a result, the peak display of relatively high brightness can be continued and a level display of the display range determined by the first or second level display range determining unit can be displayed at a relatively lower brightness. Therefore, while a user is informed by the peak display, the user is additionally informed with the decay of the level of the signal.

According to an exemplary embodiment of the present invention, since the level obtaining unit obtains the level of the signal which is input by striking a striking head, the display control of the level display device of percussion instruments in which the striking heads thereof are struck can be performed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 3A is a diagram schematically showing a peak display information memory configuration.

FIG. 3B is a diagram schematically showing a peak display information memory configuration.

FIG. 3C is a graph showing a function of brightness degradation.

FIG. 3D is a diagram showing an example of peak display in a level meter.

DESCRIPTION OF THE EMBODIMENTS

First Embodiment

Figure 1A:
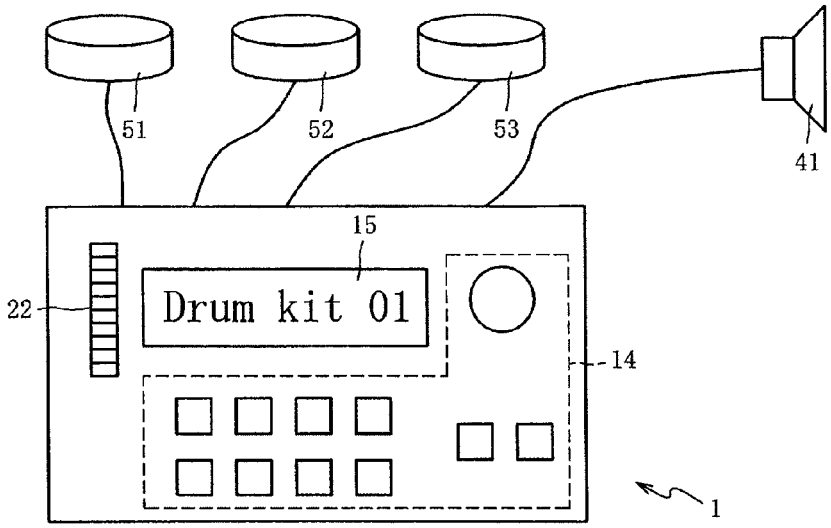
FIG. 1A is a schematic front view of a sound source device.

Reference will now be made in detail to the present preferred embodiments of the invention, examples of which are illustrated in the accompanying drawings. Wherever possible, the same reference counting numbers are used in the drawings and the description to refer to the same or like parts.

Preferred embodiments of the present invention are described with reference figures as follows. The sound source device 1 shown in FIG. 1A is an output device in which musical sound (sound) is generated based on when the pads connected thereto are struck. In the example shown in FIG. 1A, three pads 51, 52, 53 are connected to the sound source device 1. Thus, the sound source device 1 generates musical sound based on when a pad among the pads 51, 52, 53 is struck and outputs the generated musical sound from the speaker 41 connected thereto.

An operating portion 14, an LCD (liquid crystal display) 15 and a level meter 22 are disposed at the front face of the sound source device 1. The operating portion 14 has buttons, rotary knobs and the like to be operated for users to input instructions. The LCD 15 displays various types of information like setting values, setting statuses, etc. The level meter 22 displays the level of striking intensity when the pads 51, 52, 53 are struck (hereinafter it is referred to as "level"). The sound source device 1 is equipped with a display control apparatus 100 (referring to FIG. 2) of an exemplary embodiment of the display control device of the present invention. The display control apparatus 100 controls the display of the level meter 22 and can simultaneously display a plurality of levels in the level meter 22. Moreover, the recognition of the temporal sequence of each level when more than one level is simultaneously displayed can be enhanced.

Figure 1B:
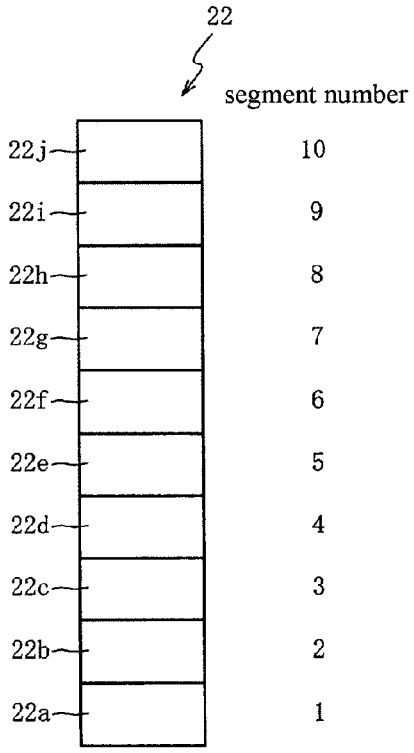
FIG. 1B is a schematic front view of a level meter.

The level meter 22 shown in FIG. 1B is divided into ten segments, more specifically, divided into a first to tenth segment 22*a* to 22*j* corresponding to segment number 1 to 10. An LED (light emitting diode) is included in each segment 22*a* to 22*j*. Each segment 22*a* to 22*j* emits light by switching on the LED included therein. When the pads 51, 52, 53 are struck, among the segments 22*a* to 22*j*, the segment corresponding to the segment number according to the striking strength is illuminated by the control of the display control apparatus 100. Specifically, the larger the striking strength becomes, the segment with a higher number emits light. In other words, the magnitude of the striking strength is reflected by the location of illuminated segment.

According to the sound source device 1 (the display control apparatus 100) of the embodiment, in the case of the pads 51 to 53 being continuously struck, each level based on a plurality of strikes can be displayed in one level meter 22 by changing the segment brightness (particularly, the brightness of LED included therein) corresponding to the peak of each level by each strike. In addition, at that time, since the newer the strike temporal sequence is, the brighter the segment brightness is controlled, the user is easy to recognize the temporal sequence of each level displayed in the level meter 22.

Figure 1C:
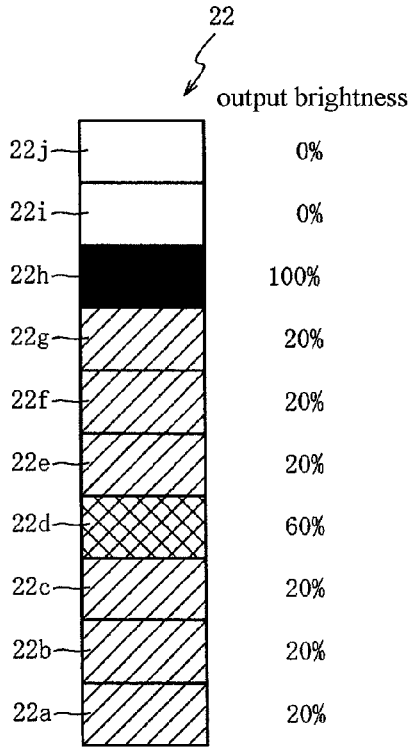
FIG. 1C is a front view of a level meter during level display.

FIG. 1C shows an example that after one of the pads 51 to 53 is struck in a striking strength corresponding to the peak level being the fourth segment 22*d*, and continuously, one of the pads 51 to 53 is struck in a striking strength corresponding to the peak level being the eighth segment 22*h*. Moreover, the pad struck in the second strike can be the same as or different to the pad struck in the previous strike. The details are described later. When the pads are struck, the segment brightness of the displaying peak based on the previous strike is decreased. As shown in FIG. 1C, the brightness (output brightness) of the eighth segment 22*h* corresponding to the peak of the level based on the second strike (the latest strike among the two strikes) is 100%. In addition, the brightness of the fourth segment 22*d* corresponding to the peak of the level based on the first strike (one previous strike of the latest strike) is set to be less than 100% (e.g., 60%).

Additionally, in FIG. 1C, FIG. 3D, FIG. 4, FIG. 7C, FIG. 8C and FIG. 9C, the illuminated segments, among the segments 22*a* to 22*j*, are hatched. In addition, the types of hatched lines are differently shown according to the brightness intensity. For instance, in FIG. 1C, the segment 22*h* having a 100% output brightness is filled up, the segment 22*d* having a 60% output brightness is hatched by cross-hatching, and the segments 22*a* to 22*c*, 22*e* to 22*g* having a 20% output brightness are hatched in positive slope. However, the same type of hatched lines attached to different figures does not represent that the output brightness thereof are the same. For instance, the same type of hatched lines is attached to the segment 22*d* in FIG. 1C and the segment 22*d* in FIG. 8C, it is not intended to represent that the brightness of the segments 22*d*, 22*d* are the same.

In addition, the first to third segments 22*a* to 22*c* and the fifth to seventh segments 22*e* to 22*g* are illuminated at a 20% brightness so as to display the level of the striking strength according to the latest strike as a bar graph. On the other hand, the ninth and tenth segments 22*i* and 22*j* corresponding to the level larger than the level of the striking strength of the latest strike are not illuminated (0% brightness).

Moreover, the details are described later. The segments, to be used in bar graph display, which are illuminated at 20% brightness, are turned off sequentially from the segment having a larger segment number according to the passing time after the strike. Accordingly, the length of the bar graph (the display range of the bar graph display) is gradually shortened according to the passing time; thus, the decay of signal (musical sound) generated based on the latest strike can be displayed.

Figure 2:
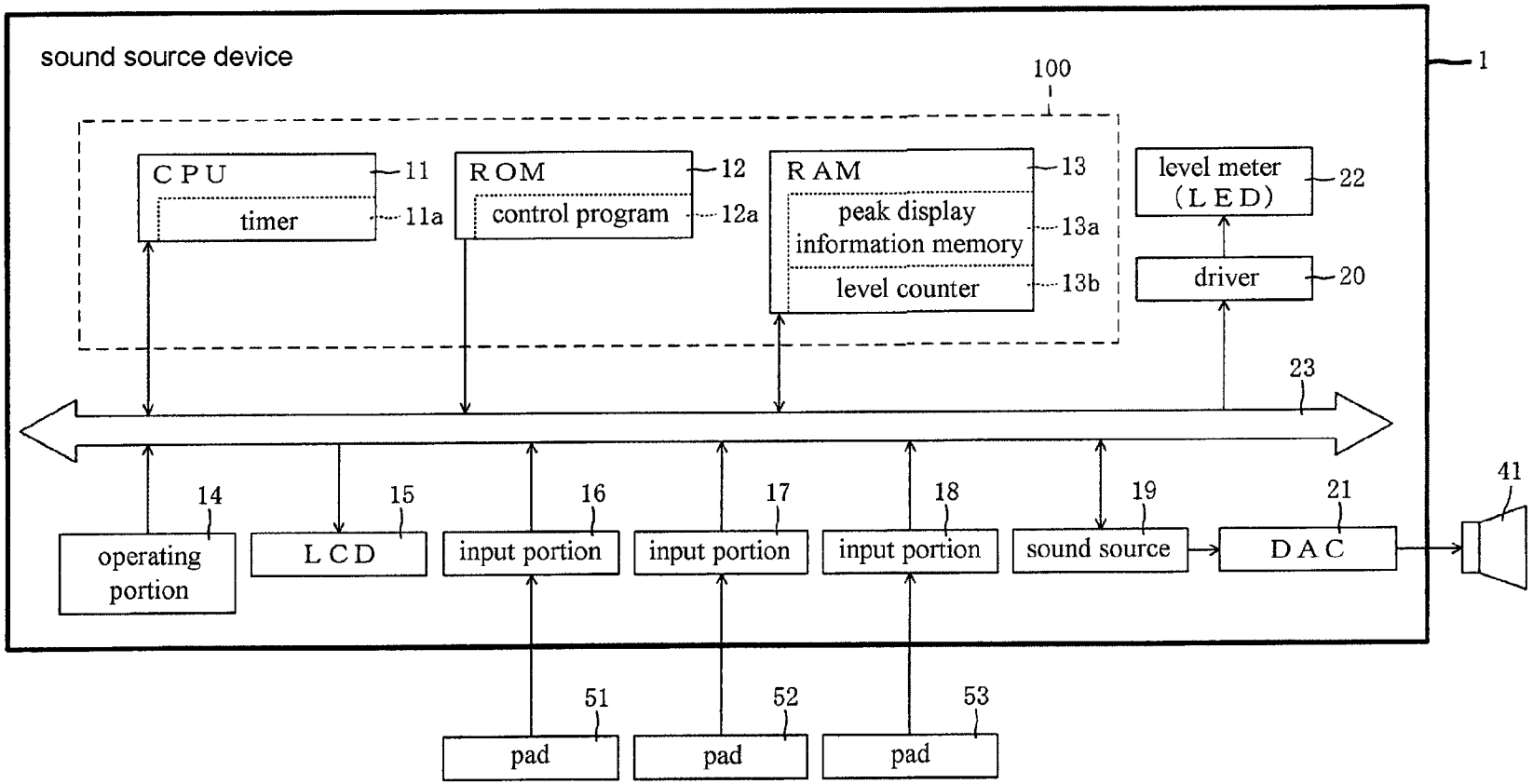
FIG. 2 is a block diagram of an electrical configuration of a sound source device.

Next referring to FIG. 2, the electrical configuration of the sound source device 1 is described. The sound source device 1 includes a CPU (central processing unit) 11, a ROM (read-only memory) 12, a RAM (random-access memory) 13, an operating portion 14, a LCD (liquid crystal display) 15, input portions 16, 17, 18, a sound source 19, a driver 20, a DAC (digital-to-analog converter) 21 and a level meter 22. Herein the display control apparatus 100 of the embodiment of the present invention is formed by the CPU 11, ROM 12 and RAM 13. Each of the components 11 to 20 are connected to each other through the bus line 23. The input portions 16 to 18 are respectively connected to the pads 51 to 53. The DAC 21 is connected to the sound source 19. The level meter 22 (more specifically, LED included in each of the first to tenth segments 22*a* to 22*j*) is connected to the driver 20.

The CPU 11 is the central control device which controls each part of the sound source device 1 according to the fixed values and program stored in the ROM 12, the data stored in the RAM 13, and so on. The CPU 11 has a timer to count the time by counting the clock signal.

Figure 5A:
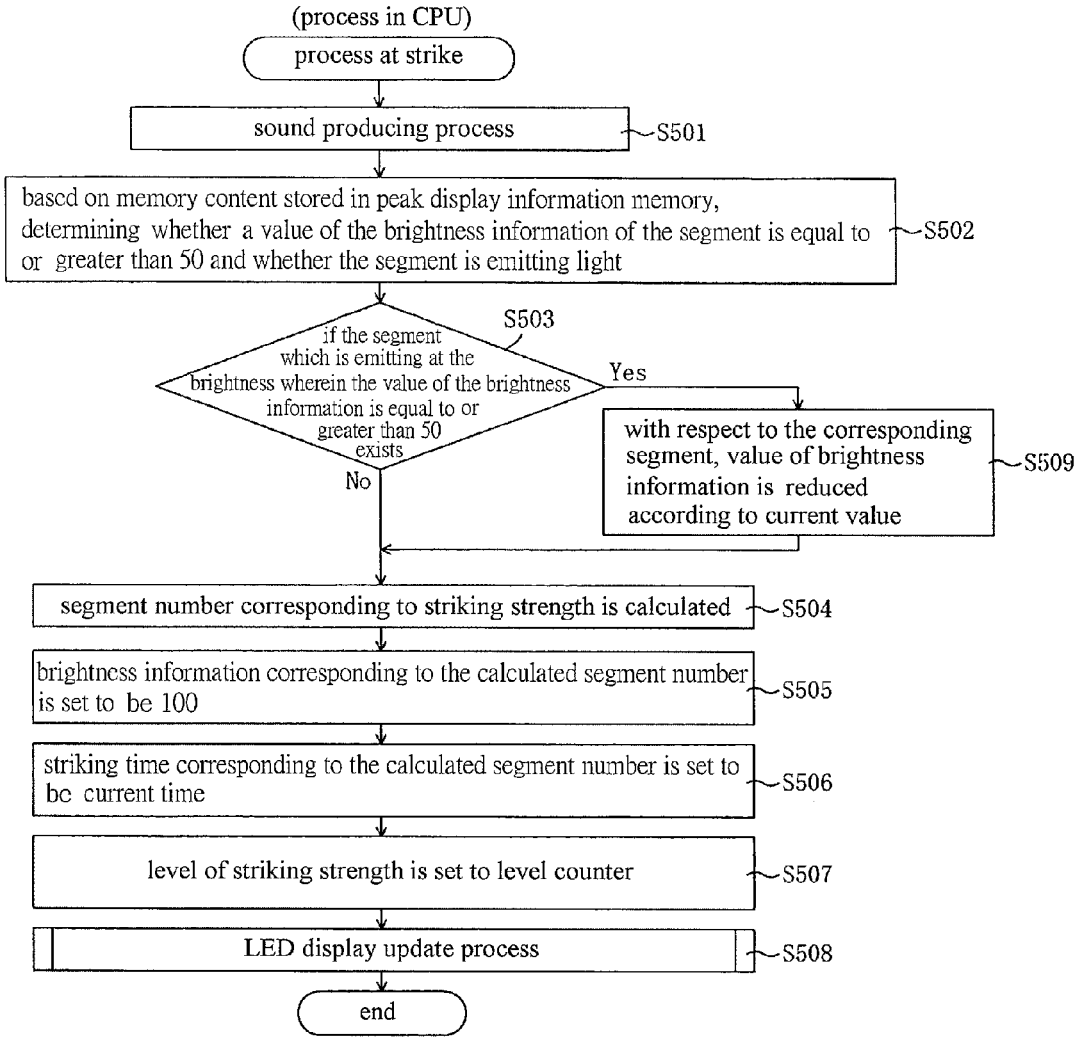
FIG. 5A is a flow chart showing a process performed by CPU during striking.
Figure 5B:
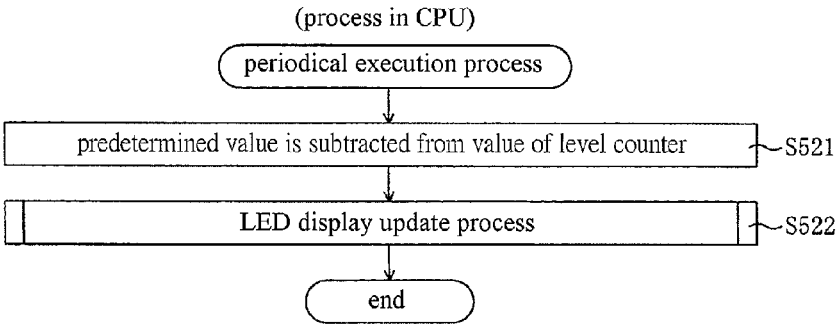
FIG. 5B is a flow chart showing a periodical execution process performed by CPU.
Figure 6:
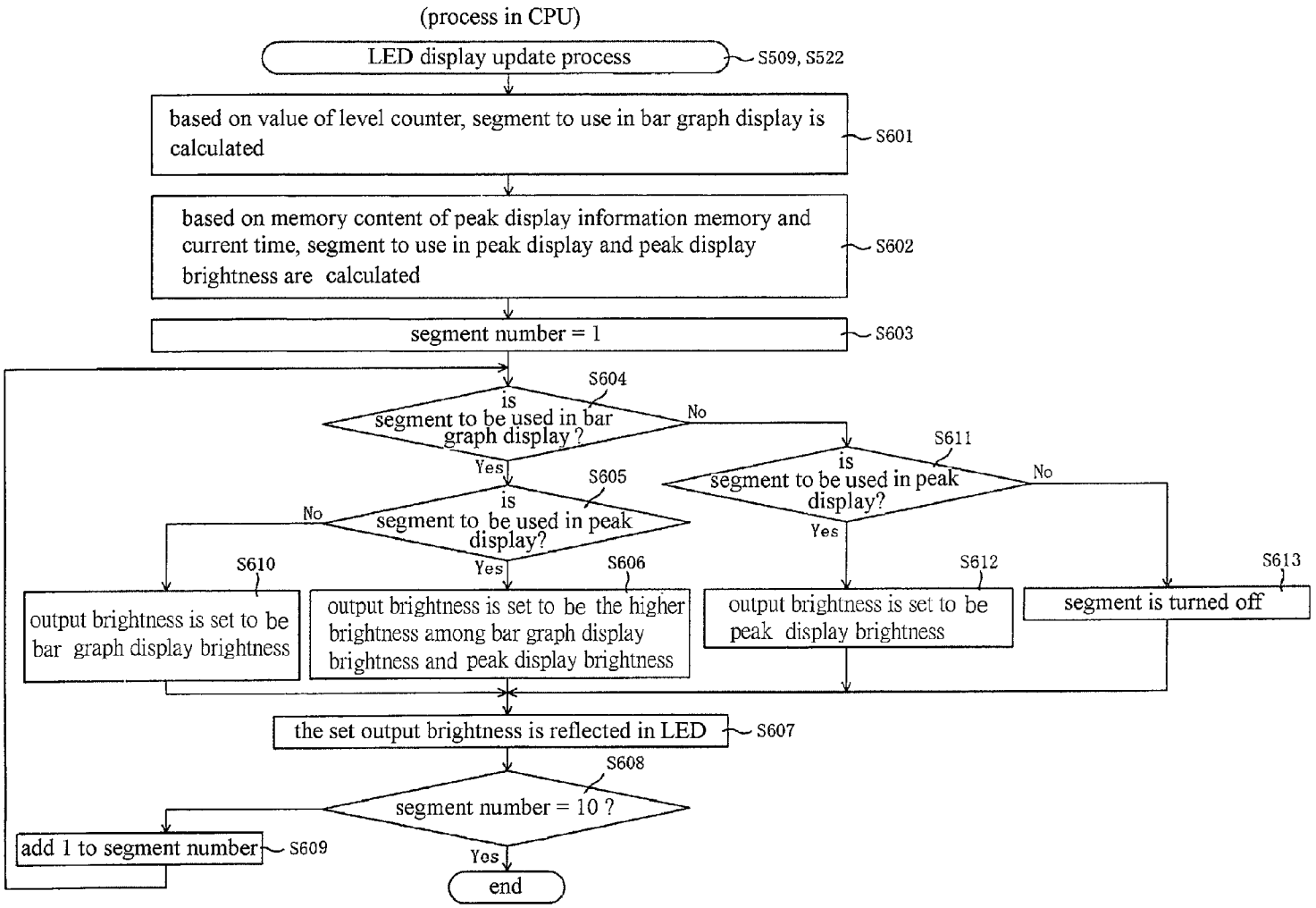
FIG. 6 is a flow chart showing a LED display update process executed in the process during striking illustrated in FIG. 5A or the periodical execution process illustrated in FIG. 5B.

The ROM 12 is a non-volatile memory and cannot be rewritten. The ROM 12 stores the control program 12*a* to be performed in the CPU 11 and the sound source 19, and the fixed values data (not shown) to be referred by the CPU 11 when the control program 12*a* is performed. Moreover, each process illustrated in the flow charts of FIG. 5A, FIG. 5B and FIG. 6 is performed based on the control program 12*a*.

The RAM 13 is a volatile memory and can be rewritten. The RAM 13 has a temporary area to temporarily store the various data when the CPU 11 executes the control program 12*a*. A peak display information memory 13*a* and a level counter 13*b* are disposed in the temporary area of the RAM 13. Any of the peak display information memory 13*a* and the level counter 13*b* is cleared when the power of the sound source device 1 is turned on.

The peak display information memory 13*a* is a memory to store the information for displaying the peak of the level based on the strike of the pads 51 to 53 in the level meter 22 (segments 22*a* to 22*j*). The segment numbers corresponding to the peak of the level, brightness information and striking time based on every time when any of the pads 51 to 53 is struck are correspondingly stored in the peak display information memory 13*a*. The details of the peak display information memory 13*a* are described later with the accompanying of FIG. 3A to FIG. 3D.

The level counter 13*b* is a counter to use for determining the segment out of the segments 22*a* to 22*j* to be used in bar graph display based on the latest strike. The level of striking strength of every time when the pads 51 to 53 are struck is set to be an initial value in the level counter 13*b*. After the initial value is set, the value is subtracted by a predetermined value at every predetermined time (in the embodiment, in every 10 msec).

The input portions 16 to 18 are interfaces to respectively connect each of the vibrating sensors (not shown) disposed in each pad 51 to 53. The input portions 16 to 18 have the same configuration except being connected to different pads 51 to 53, thus the input portion 16 is described in the following as a representative. The analog signal output from the vibrating sensor of the pad 51 is input to the sound source device 1 through the input portion 16. The input portion 16 has an analog digital converter (not shown) built therein. The analog signal input from the vibrating sensor of the pad 51 is converted into a digital value at every predetermined time by the analog digital converter and output to the CPU 11. The CPU 11 determines that the pad 51 is struck when the level of the signal input from the vibrating sensor of the pad 51 exceeds the predetermined threshold value. Moreover, a generating instruction is output to the sound source 19 by the CPU 11, wherein the generating instruction instructs that the musical sound of the tone corresponding to the pad 51 determined being struck is output in a volume according to the striking strength.

When the sound source 19 receives the generating instruction of the musical sound from the CPU 11, a musical sound of the tone and volume according to the generating instruction is generated. A waveform ROM (not shown) is built in the sound source 19. Digital musical sounds of the tone respectively corresponding to the pads 51 to 53 are stored in the waveform ROM. Moreover, a DSP (digital signal processor) (not shown) for the process such as filter, effects and the like is built in the sound source 19. When the generating instruction is input from the CPU 11, the sound source 19 retrieves the digital musical sound of the tone according to the generating instruction out of the waveform ROM. In addition, regarding the retrieved digital musical sound, the sound source 19 performs the predetermined process of filter, effects and the like in the DSP, and the processed digital musical sound is output to the DAC 21. The DAC 21 converts the input digital musical sound into the analog musical sound and output to the speaker 41 disposed outside the sound source device 1. As such, the musical sound based on the struck of pads 51 to 53 is released from the speaker 41.

The driver 20 is connected to the LEDs which is respectively included in the segments 22*a* to 22*j* which forms the level meter 22, and the driver 20 is an LED driver that makes each of the LEDs illuminate. The driver 20 makes the indicated LED illuminate according to the control information to indicate the illumination manner input from the CPU 11. The driver 20 controls the brightness of each LED according to the PWM (pulse width modulation) control. As a result, when the control information provided from the CPU 11 is the information that indicates the brightness of the LEDs, the power pulse of the duty ratio corresponding to the indicated brightness is supplied to the LEDs as a controlled object. Accordingly, each LED included in the segments 22*a* to 22*j* is illuminated at the brightness corresponding to the duty ratio of the supplied power pulse, i.e., the brightness indicated by the CPU 11.

Herein referring to FIG. 3A to FIG. 3D, correlations of memory contents of the peak display information memory 13*a* and the peak display (the display of peak based on the struck) displayed in the level meter 22 are described.

As shown in FIG. 3A and FIG. 3B, the peak display information memory 13*a* includes an area 13*a*1 to store the segment numbers, an area 13*a*2 to store the brightness information and an area 13*a*3 to store the striking time. In the area 13*a*1, segment numbers 1 to 10 to respectively define the first to tenth segments 22*a* to 22*j* are stored. In the case of any of the pads 51 to 53 being struck, the brightness information and the striking time are respectively stored in the areas 13*a*2 and 13*a*3 corresponding to the segment numbers which are corresponding to the striking strength.

More specifically, in FIG. 3A, with respect to any of the pads 51 to 53, when the pad is continuously struck twice, the memory content of the peak display information memory 13*a* for the first strike is shown as an example. In FIG. 3B, with respect to any of the pads 51 to 53, when the pad is continuously struck twice, the memory content of the peak display information memory 13*a* for the second strike continued to the first strike is shown as an example. In addition, in FIG. 3A and FIG. 3B, the display of the brightness information and the striking time with respect to the segment numbers, which are not the objects of the peak display is omitted due to the reasons such as sufficient time has passed after the strikes.

As shown in the example illustrated in FIG. 3A, the brightness information (100) and the striking time (ts1) corresponding to the segment number 4 are stored. In other words, it is illustrated that the first strike is performed in the level corresponding to the segment number 4. The brightness information is set to be 100 with regard to the strike (i.e., the latest strike) of every time any of the pads 51 to 53 is struck. Moreover, the striking time is the current time obtained by the timer 11*a* at the timing in which any of the pads 51 to 53 is struck.

As shown in the example illustrated in FIG. 3B, the brightness information (100) and the striking time (ts2, ts2>ts1) with regard to the segment number 8 are stored along with the brightness information (60) and the striking time (ts1) with regard to the segment number 4. In other words, after the first strike (the strike performed in the level corresponding to the segment number 4), the second strike is performed in the level corresponding to the segment number 8. In this situation, since the second strike is the latest strike, the value 100 with regard to the segment number 8 is stored as the brightness information.

On the other hand, the brightness information of the first strike which is the previous strike of the latest strike is changed from 100 to 60. As such, in the display control apparatus 100 of the embodiment, when any of the pads 51 to 53 is struck, the brightness information (i.e., the brightness information stored based on the strike which is one or more previous strike of the latest strike) already stored in the peak display information memory 13*a*1 is reduced to a predetermined value which is smaller than the current value. Specifically, among the brightness information, which is already stored in the peak display information memory 13*a*, the brightness information which is equal to or greater than 50 and is corresponding to the segment of emitting (lightened up) is reduced to a predetermined value relatively smaller than the current value.

For instance, in the embodiment, if the current value of the targeted brightness information is 100, then the value is changed to 60. Moreover, if the value of the targeted brightness information is 60, then the value is changed to 50. Moreover, if the value of the targeted brightness information is 50, then the value is changed to 40. In other words, the value of the brightness information based on the latest strike is 100, the value of the brightness information based on the strike which is one strike previous the latest strike is 60, the value of the brightness information based on the strike which is two strikes previous the latest strike is 50, and the value of the brightness information based on the strike which is three strikes previous the latest strike is 40. Accordingly, the values of the brightness information stored in the peak display information memory 13*a* are the values that reflect the temporal sequence of the struck pads 51 to 53.

The brightness (hereinafter, the brightness is defined as "peak display brightness") to perform the peak display is calculated based on the values of the brightness information and the passing time from the time being struck. Specifically, the peak display brightness (%) is the value in which the value of the brightness information is multiplied by a brightness reduction coefficient corresponding to the passing time from the time being struck. Accordingly, the larger the value of the brightness information, the higher the peak display brightness (%) is. As described above, since the value of the brightness information becomes larger with the latest degree of the strike with regard to the pads 51 to 53, the peak display brightness becomes higher with the latest degree of the strike with regard to the pads 51 to 53. In other words, the temporal sequence of the struck pads 51 to 53 is displayed according to the brightness of the peak display brightness.

On the other hand, the brightness reduction coefficient corresponding to the passing time from the time being struck is calculated based on the brightness reduction function which is specified in advance. The brightness reduction function can be stored in a predetermined area of the ROM 12 or can also be stored in the ROM 12 as a portion of the control program 12*a*.

Herein referring to FIG. 3C, the brightness reduction function is described. In the graph shown in FIG. 3C, the vertical axis (y axis) represents the brightness, and the horizontal axis (x axis) represents the passing time from the time being struck. In the brightness reduction function, the brightness when the passing time from the time being struck is zero (i.e., when it is struck) is set to 100 and the function defines the decrease of the brightness with the passing time after struck. According to the brightness reduction function, the brightness becomes zero after a predetermined time from the time being struck.

As shown in the example illustrated in FIG. 3C, the brightness corresponding to the passing time from the time being struck is linearly decreased and the brightness reduction function is defined as a linear function in which the brightness becomes zero, when the passing time from the time being struck is T, i.e., $y=-(100/T)x+100$. The passing time from the time being struck is calculated by subtracting the value of striking time (tsn, n is an integer greater than or equal to 1) from the current time indicated by the timer 11*a*. As a result, according to the brightness reduction function illustrated in FIG. 3C, the brightness corresponding to the passing time from the time being struck (Bn, n is an integer greater than or equal to 1) is calculated by $-(100/T)\times(\text{current time}-\text{tsn})+100$. The brightness reduction coefficient is the value of the brightness corresponding to the passing time from the time being struck Bn divided by the brightness at the time being struck 100, i.e., (Bn/100).

FIG. 3D illustrates the segment position and the peak display brightness thereof to perform the peak display in the level meter 22 according to the memory content of the peak display information memory 13*a* illustrated in FIG. 3B.

According to the memory content of the peak display information memory 13*a* illustrated in FIG. 3B, the brightness information (100) and the striking time (ts2) are stored with respect to the segment number 8, as the information of the second strike among the two continuous strikes. Based on the brightness reduction function as illustrated in FIG. 3C, the brightness B2 corresponding to the passing time from the time being struck is calculated from the striking time (ts2) and the current time, and the brightness reduction coefficient (B2/100) is obtained. As a result, the peak display brightness (%) of segment 22*h* corresponding to the segment number 8 in the level meter 22 is determined to be 100×(B2/100). In addition, since in the second strike (the timing of the strike), the passing time from the time being struck is zero and B2 is 100, the peak display brightness of the segment 22*h* of the second strike is 100%.

On the other hand, the brightness information (60) and the striking time (ts1) are stored with respect to the segment number 4 as the information corresponding to the first strike among the two continuous strikes. Based on the brightness reduction function illustrated in FIG. 3C, the brightness B1 corresponding to the passing time from the time being struck is calculated from the striking time (ts1) and the current time and the brightness reduction coefficient (B1/100) is obtained. As a result, the peak display brightness (%) of segment 22*d* corresponding to the segment number 4 in the level meter 22 is determined to be 60×(B1/100).

In addition, the peak display is not performed in the segments 22*a* to 22*c*, 22*e* to 22*g*, 22*i* and 22*j* corresponding to the segment numbers which are not the objects of peak display. In other words, the peak display brightness of those segments 22*a* to 22*c*, 22*e* to 22*g*, 22*i* and 22*j* is 0%.

Figure 4:
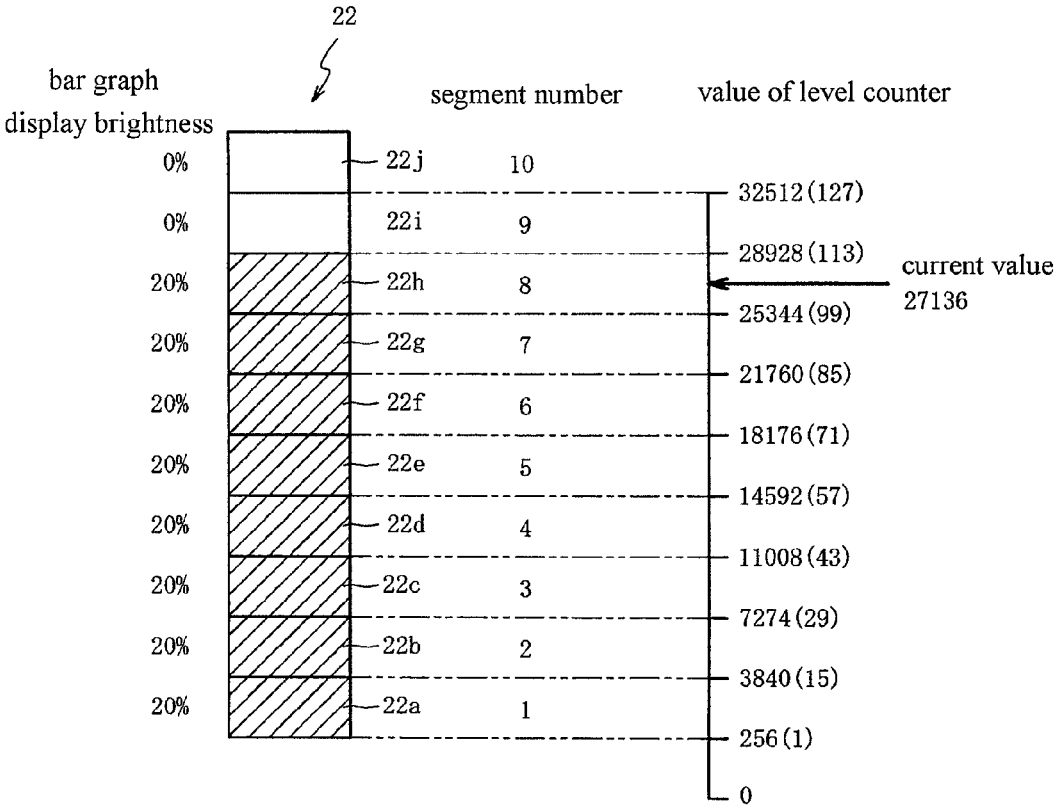
FIG. 4 shows a correlation between a current value of level counter and a display range of bar graph display displayed in level meter.

After that, referring to FIG. 4, the correlation between the current value of the level counter 13*b* and the length of the bar graph displayed in level meter 22 (the display range of the bar graph display) is described.

As shown in FIG. 4, with respect to the values of the level counter 13*b*, the segment numbers are assigned to define the segments 22*a* to 22*j*. Moreover, in FIG. 4, the values in the round parentheses next to the values of level counter 13*b* are the corresponding striking strength. The values in which each of the striking strength is multiplied by 256 are stored as the levels of the striking strength in the level counter 13*b* when the pads 51 to 53 are struck. Since the maximum of the striking strength is 127, the level counter 13*b* can be the values from 0 to 32512. As a result, the segment numbers are assigned according to the values of the level counter 13*b* of the range from 0 to 32512.

Specifically, as for the value of the level counter 13*b*=32512, the segment number 10 is assigned. As for the value of the level counter 13*b* of the range from 28928 to 32511, the segment number 9 is assigned. As for the value of the level counter 13*b* of the range from 25344 to 28927, the segment number 8 is assigned. As for the value of the level counter 13*b* of the range from 21760 to 25343, the segment number 7 is assigned. As for the value of the level counter 13*b* of the range from 18176 to 21759, the segment number 6 is assigned. As for the value of the level counter 13*b* of the range from 14592 to 18175, the segment number 5 is assigned. As for the value of the level counter 13*b* of the range from 11008 to 14591, the segment number 4 is assigned. As for the value of the level counter 13*b* of the range from 7274 to 11007, the segment number 3 is assigned. As for the value of the level counter 13*b* of the range from 3840 to 7273, the segment number 2 is assigned. As for the value of the level counter 13*b* of the range from 256 to 3839, the segment number 1 is assigned. In addition, as for the value of the level counter 13*b* of the range from 0 to 255, no segment number is assigned.

The segment to use in the bar graph display is determined according to the current value of the level counter 13*b*. Specifically, the segment corresponding to the segment number assigned according to the range including the current value of the level counter and the segment corresponding to the segment number which is smaller than that segment number are used in the bar graph display. For instance, as shown in FIG. 4, in the case that the current value of the level counter 13*b* is 27136, since the segment number assigned according to the range according the current value is 8, the segments 22*a* to 22*h* corresponding to the segment number 1 to 8 are used in the bar graph display.

In the bar graph display, the segments determined as the segment to use in the bar graph display are performed to be illuminated at the brightness of 20%. As a result, with respect to the segments to use in the bar graph display, the brightness to display the bar graph (bar graph display brightness) is determined to be 20%. As shown in FIG. 4, the bar graph display brightness is determined to be 20% with respect to the segments 22*a* to 22*h* corresponding to the segment numbers 1 to 8. On the other hand, the segments 22*i* and 22*j* which are the segments not to use in the bar graph display are not performed in the bar graph display. In other words, the bar graph display brightness of those segments is 0%.

Since the value of the level counter 13*b* is subtracted by a predetermined value at every predetermined time (in the embodiment, in every 10 msec), the segment number corresponding to the value of the level counter 13*b* becomes smaller as the time passes. As a result, the length of the bar graph (the display range of the bar graph) becomes shorter as the time passes. Then, when the value of the level counter 13*b* reaches 255, the segment number corresponding to the value of the level counter 13*b* is no longer assigned and the display range of the bar graph display becomes zero and the bar graph display is vanished.

Further, it is described later in detail that among the aforementioned bar graph display brightness and the peak display brightness (referring to FIG. 3A to FIG. 3D), the higher brightness is the output brightness (the brightness due to the actual emission) of each segment 22*a* to 22*j*.

Then, referring to FIG. 5A, FIG. 5B and FIG. 6, the process executed by the CPU 11 of the aforementioned sound source device 1 (the display control apparatus 100) is described. The process during striking illustrated in FIG. 5A is executed in the condition when the CPU 11 determines that the level of the signal input through the input portions 16 to 19 from the vibrating sensor (not shown) of any of the pads 51 to 53 exceeds the predetermined threshold value (i.e., any of the pads 51 to 53 is struck).

First, the CPU 11 executes a sound producing process corresponding to the struck pad among the pads 51 to 53 (S501). Specifically, in step S501, the CPU 11 outputs a generating instruction to the sound source 19 for the musical sound of the struck pad to be generated.

Then, based on the memory content of the peak display information memory 13*a*, the CPU 11 determines whether the value of the brightness information of the segment is equal to or greater than 50 and whether the segment is emitting light (S502). And in the step S502, based on the brightness reduction function, the CPU 11 determines that the segment whose brightness corresponding to the passing time from the time being struck is larger than 0 is the segment that is emitting.

If the CPU 11 determines that the segment which is emitting at the brightness wherein the value of the brightness information is equal to or greater than 50 exists (S503: YES), the CPU 11 reduces the value of the brightness information according to the current value (S509) and proceeds to the process of S504. Specifically, in the step S509, the CPU 11 respectively lowers the values to 60, 50 or 40 in case that the current values of the brightness information are 100, 60 or 50.

On the other hand, if the CPU 11 determines no segment is emitting or although the segment is emitting it is not with a value of the brightness information equal to or greater than 50 (S503: NO), the CPU proceeds to the step S504. In the step S504, the CPU 11 calculates the segment numbers corresponding to the striking strength (S504). In the step S504, the segment numbers are calculated by the value of the striking strength obtained in the range from 1 to 127 being divided by 14 and rounded up the decimal. In the step S504, a conversion table associated with the striking strength and the segment numbers can be prepared in advance and the striking strength can be respectively converted into the segment numbers by using the conversion table.

Next, the CPU 11 sets the brightness information corresponding to the calculated segment number in the peak display information memory 13*a* to be 100 (S505). Further, the CPU 11 sets the striking time corresponding to the calculated segment number in the peak display information memory 13*a* to be the current time obtained from the timer 11*a* (S506). And then, the CPU 11 sets the level of the striking strength in the level counter 13*b* (S507). Specifically, in the step S507, the CPU 11 sets the value in which the striking strength obtained in the range from 1 to 127 is multiplied by 256 (the level of the striking strength) in the level counter 13*b*.

After the process of S507, the CPU 11 executes the LED display update process (S508) and the process is completed. The LED display update process (S508) is the process in which, based on the current strike (the latest strike), the brightness of each LED included in the segments 22*a* to 22*j* is updated. The detailed of the LED display update process (S508) is described in the following with FIG. 6.

FIG. 5B is a flow chart showing the periodical execution process performed by CPU 11. The periodical execution process is the repeatedly executed process, while the power is supplied to the sound source device 1 (the display control apparatus 100).

First, the CPU 11 subtracts a predetermined value from the value of the level counter 13*b* (S521). Then, CPU 11 executes the LED display update process similar to the abovementioned process of step S508 (S522), and the process is completed.

In the LED display update process (S508, S522) as shown in FIG. 6, the CPU 11, first based on the value of the level counter 13*b*, calculates the segment, among the segments 22*a* to 22*j*, to use in the bar graph display (i.e., the segment for the bar graph display brightness of 20%) (S601).

Then, the CPU 11, based on the memory content (the segment number 13*a*1, the brightness information 13*a*2, the striking time 13*a*3) of the peak display information memory 13*a* and the current time obtained from the timer 11*a*, calculates the segment, among the segments 22*a* to 22*j*, to use in the peak display and the peak display brightness (%) (S602).

After the process of S602, the CPU 11 lets the segment of the segment number 1, i.e. the first segment 22*a* to be the processing target (S603). Next, if the segment corresponding to the segment number of the processing target is the segment to be used in the bar graph display and is the segment to be used in the peak-display (S604: YES, S605: YES), the CPU 11 sets the output brightness to be the higher brightness among the brightness of 20%, which is the bar graph display brightness and the peak display brightness (%) calculated in the step S602 (S606) and proceeds to the process of S607.

On the other hand, if the segment corresponding to the segment number of the processing target is the segment to be used in the bar graph display and is not the segment to be used in peak-display (S604: YES, S605: NO), the peak display brightness in the segment of the processing target is 0%; thus, the CPU 11 sets the output brightness to be the brightness of 20%, which is the bar graph display brightness (S610), and proceeds to the process of S607.

In addition, if the segment corresponding to the segment number of the processing target is not the segment to be used in the bar graph display and is the segment to be used in the peak display (S604: NO, S611: YES), the bar graph display brightness in the segment of the processing target is 0%; thus, the CPU 11 sets the output brightness to be the peak display brightness (%) calculated in the step S602 (S612) and proceeds to the process S607.

Then, if the segment corresponding to the segment number of the processing target is not the segment to be used in the bar graph display and is not the segment to be used in the peak display (S604: NO, S611: NO), the CPU 11 turns off the segment (i.e., the brightness is set to be 0%) (S613) and proceeds to the process of S607.

In the step S607, the CPU 11 outputs the output brightness which is set in the steps S606, S610, S612, S613 to the driver 20 (S607). The driver 20 controls the brightness of the LEDs included in the segments of the processing target by using the PWM control according to the output brightness which is input.

After the process of S607, if the segment number of the processing target is not 10, the CPU 11 adds 1 to the segment number (S609), proceeds to the process of S604, lets the next segment to be the processing target and executes the process of S604 to S607, S610 to S613. On the other hand, in the step S608, if the segment number of the processing target is 10 (S608: YES), since the process corresponding to all of the segments 22*a* to 22*j* is performed, the CPU 11 completes the process.

Figures 7A, 7B, 7C:
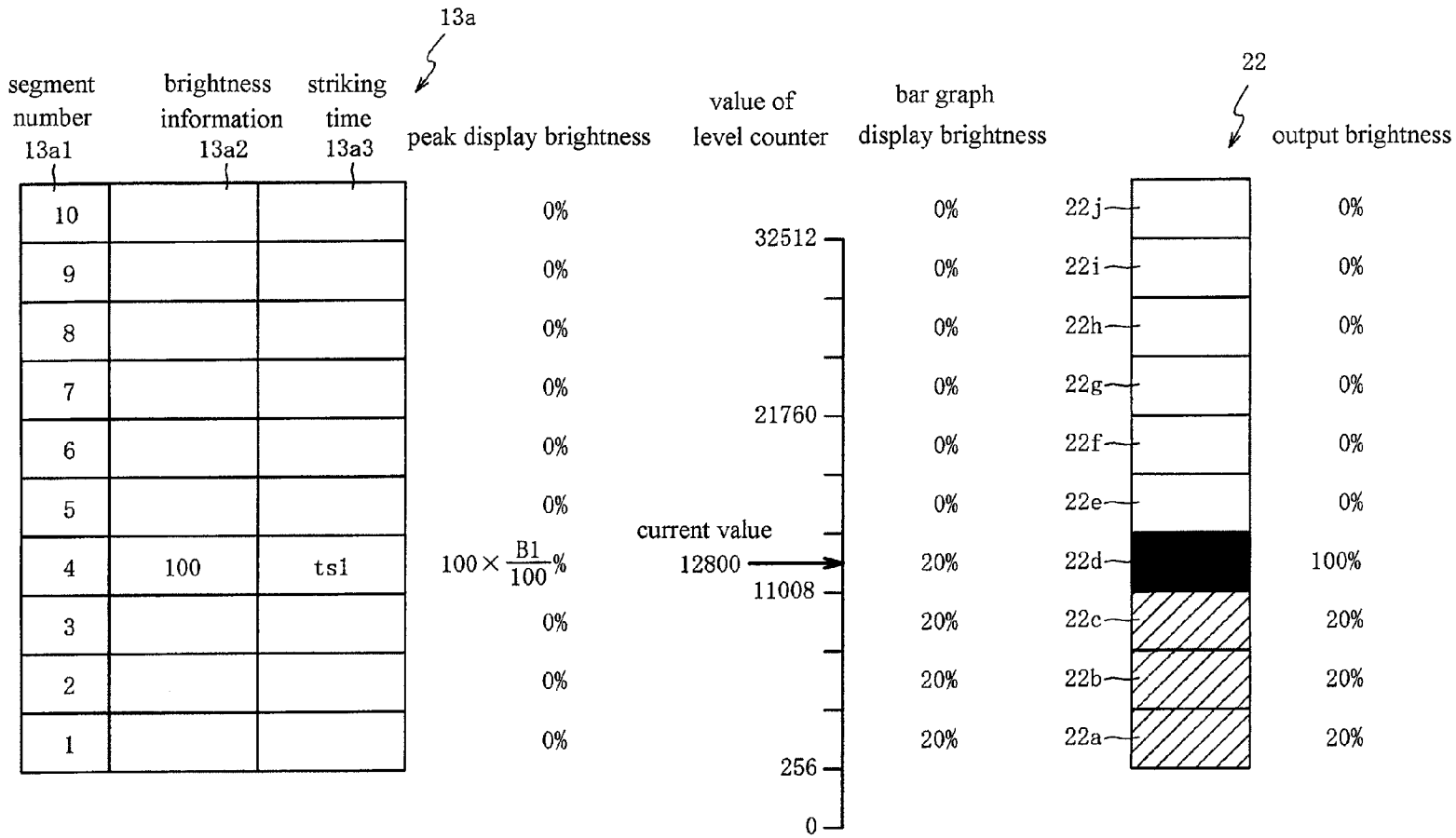
FIG. 7A shows a peak display intensity of the level meter during the first strike.
FIG. 7B shows a bar graph display intensity of the level meter during the first strike.
FIG. 7C shows an output brightness of the level meter during the first strike.

Then, referring to FIG. 7A to FIG. 9C, an example of the display change of the level meter 22 according to the control of the display control apparatus 100 (i.e., each process illustrated in FIG. 5A, FIG. 5B and FIG. 6) is described. First, FIG. 7A to FIG. 7C show the display of the level meter 22 in the first strike. And the first strike is performed in the conditions of the striking time=ts1, the striking strength=50, and the current value of the level counter=12800.

Since the striking strength of the first strike is 50, the corresponding segment number is 4. As a result, as shown in FIG. 7A, the brightness information (100) and the striking time (ts1) corresponding to the segment number 4 are stored in the peak display information memory 13*a*. Based on the memory content of the peak display information memory 13*a*, the brightness reduction function (referring to FIG. 3C) is used to determine that the peak display brightness (%) of the segment 22*d* corresponding to the segment number 4 is 100×(B1/100). However, in the first strike (the timing of the strike), since the passing time from the time being struck is zero and B1=100, the peak display brightness of the segment 22*d* of the first strike is 100%. On the other hand, the peak display brightness of the segments other than the segment 22*d* (22*a* to 22*c*, 22*e* to 22*j*) is determined to be 0%.

In addition, the value (12800) in which the striking strength (50) of the first strike is multiplied by 256 is set in the level counter 13*b*. As a result, since the segment number assigned according to the range including 12800 is 4, the segments 22*a* to 22*d* corresponding to the segment numbers 1 to 4 are determined as the segments to use in the bar graph display. Accordingly, as shown in FIG. 7B, the bar graph display brightness corresponding to those segments 22*a* to 22*d* are determined to be 20%. On the other hand, the bar graph display brightness corresponding to the segments 22*e* to 22*j* is determined to be 0%.

The output brightness of each of the segments 22*a* to 22*j* (the brightness of the actual emission) is set to be the higher brightness among the peak display brightness determined according to the memory content of the peak display information memory 13*a* and the bar graph display brightness determined according to the current value of the level counter 13*b*. As a result, as shown in FIG. 7C, the output brightness of the segments 22*a* to 22*c* in which the peak display brightness is 0% and the bar graph display brightness is 20% is determined to be 20%. In addition, the output brightness of the segment 22*d* in which the peak display brightness is 100% and the bar graph display brightness is 20% is determined to be 100%. Since the peak display brightness and the bar graph display brightness of the segments 22*e* to 22*j* are 0%, the output brightness of those segments 22*e* to 22*j* is 0%.

As a result, the fourth segment 22*d* corresponding to the peak of the level of the striking strength based on the first strike is illuminated at the highest brightness, and the first to third segments 22*a* to 22*c* are illuminated at a low brightness as the bar graph which shows the level of the striking strength based on the first strike.

Figures 8A, 8B, 8C:
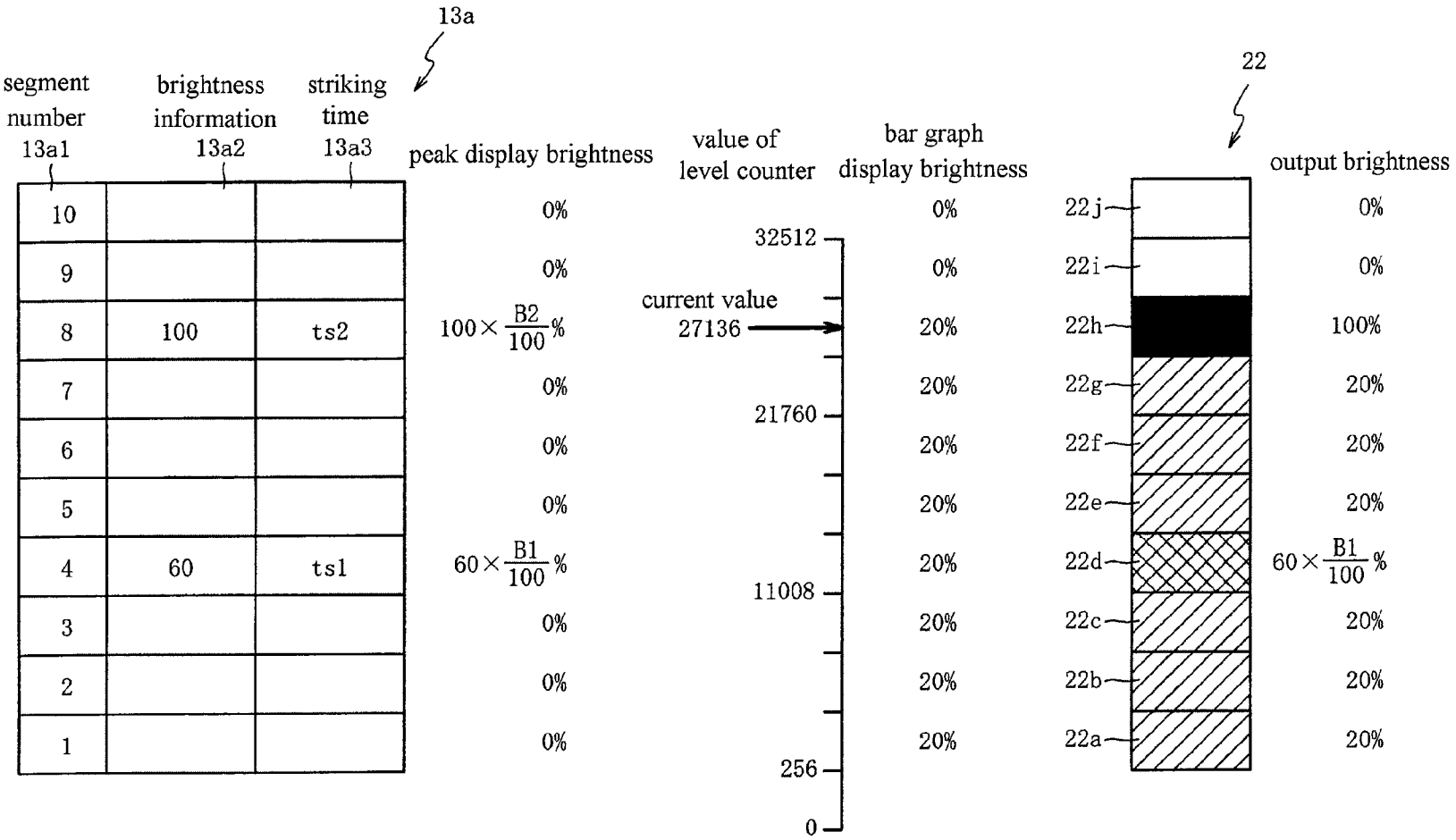
FIG. 8A shows a peak display intensity of the level meter during the second strike.
FIG. 8B shows a bar graph display intensity of the level meter during the second strike.
FIG. 8C shows an output brightness of the level meter during the second strike.

In FIG. 8A to FIG. 8C, the display of the level meter 22 when the second strike of which strength is stronger than the first strike is performed continuously in a sufficient short time from the first strike is illustrated. And the second strike is performed at the striking time=ts2 (ts2>ts1), the striking strength=106, and the current value of the level counter=27136.

Since the strength of the second strike is 106, the corresponding segment number is 8. As shown in FIG. 8A, with respect to the segment number 8, the brightness information (100) and the striking time (ts2) are stored in the peak display information memory 13*a*. On the other hand, the brightness information corresponding to the segment number 4 based on the first strike is changed to 60. The peak display brightness (%) of the segment 22*h* corresponding to the segment number 8 is determined to be 100×(B2/100). However, since the passing time from the time being struck in the second strike (the striking timing) is zero, the peak display brightness of the segment 22*h* in the second strike is 100%.

On the other hand, the peak display brightness (%) of the segment 22*d* corresponding to the segment number 4 is determined to be 60×(B1/100). And the peak display brightness of the segments (segments 22*a* to 22*c*, 22*e* to 22*g*, 22*i*, 22*j*) other than the segments 22*d* and 22*h* is determined to be 0%.

Additionally, the value (27136) in which the striking strength (106) of the second strike is multiplied by 256 is set in the level counter 13*b*. As a result, since the segment number assigned corresponding to the range including 27136 is 8, the segments 22*a* to 22*h* corresponding to the segment numbers 1 to 8 are determined to be the segments used in the bar graph display. As a result, as shown in FIG. 8B, the bar graph display brightness corresponding to those segments 22*a* to 22*h* is determined to be 20%. On the other hand, the bar graph display brightness corresponding to the segments 22*i* and 22*j* is determined to be 0%.

As shown in FIG. 8C, the output brightness of the segments 22*a* to 22*c*, 22*e* to 22*g*, in which the peak display brightness is 0% and the bar graph display brightness is 20%, is determined to be 20%. In addition, the output brightness of the segment 22*d*, in which the peak display brightness is 60×(B1/100)% and the bar graph display brightness is 20%, is set to be the higher brightness among the peak display brightness and the bar graph display brightness. However, in this example, since the interval time between the first strike and the second strike is sufficiently short, the segment 22*d* is illuminated at the brightness of 60×(B1/100)%. The output brightness of the segment 22*h*, in which the peak display brightness is 100% and the bar graph display brightness is 20%, is determined to be 100%. Since the peak display brightness and the bar graph display brightness of the segments 22*i* and 22*j* are 0%, the output brightness of those segments 22*i* and 22*j* is 0%.

As a result, the eighth segment 22*h* corresponding to the peak of the level of the striking strength based on the second strike is illuminated at the highest brightness. The fourth segment 22*d* corresponding to the peak of the level of the striking strength based on the first strike is illuminated at a lower brightness than the eighth segment 22*h*. The first to third segments 22*a* to 22*c* and the fifth to seventh segments 22*e* to 22*g* are illuminated at a low brightness as the bar graph to display the level of the striking strength based on the second strike.

Figures 9A, 9B, 9C:
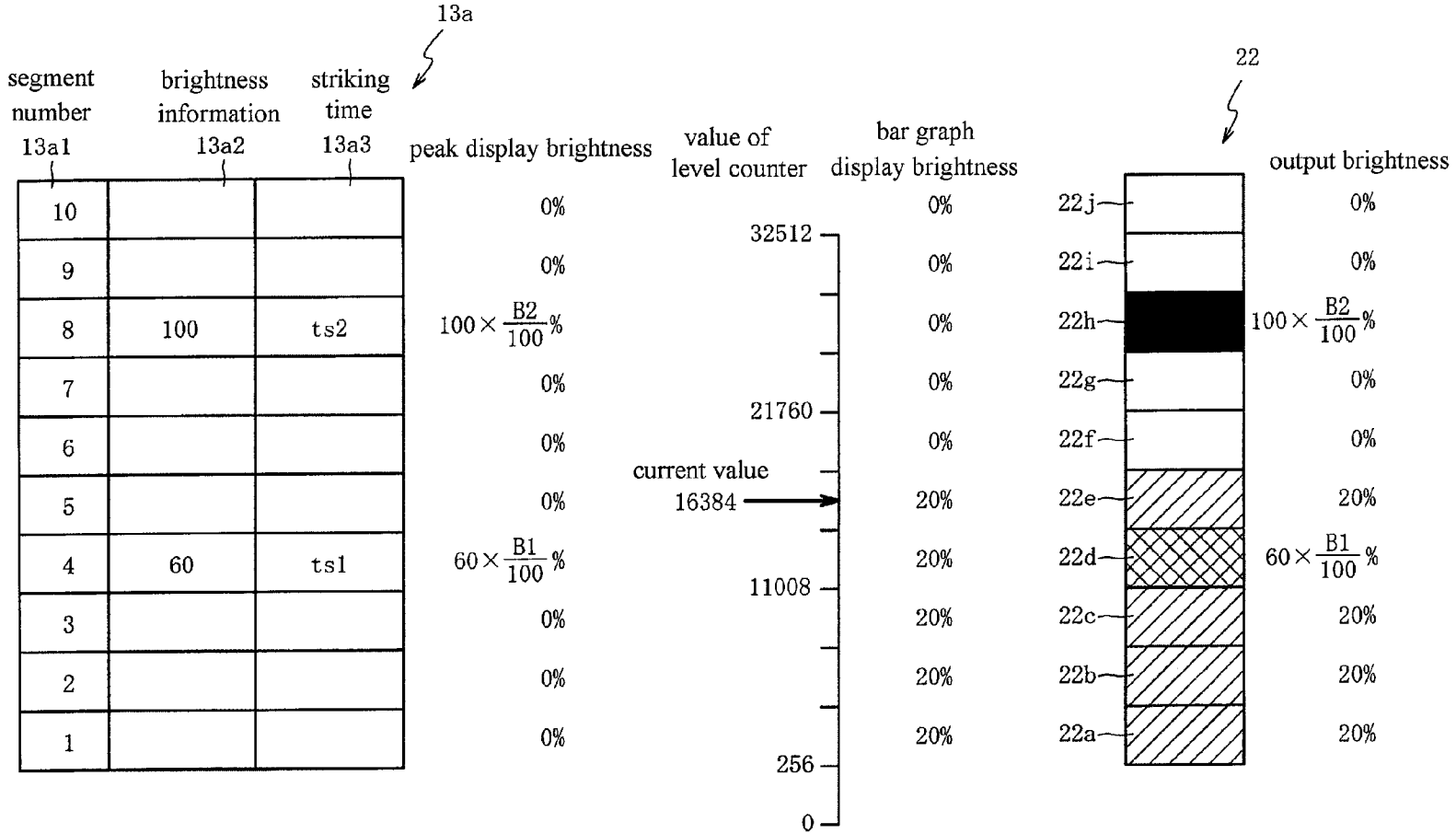
FIG. 9A shows a peak display intensity of the level meter after a predetermined time from the second strike.
FIG. 9B shows a bar graph display intensity of the level meter after the predetermined time from the second strike.
FIG. 9C shows an output brightness of the level meter after the predetermined time from the second strike.

FIG. 9A to FIG. 9C illustrate the display of the level meter 22 after a predetermined time from the second strike (the current value of the level counter=16384). And the example shown in FIG. 9A to FIG. 9C illustrates the display of the level meter 22 when the value of the level counter 13*b* is reduced to 16384 along with the time passing after the second strike. However, in the example shown in FIG. 9A to FIG. 9C, the peak display brightness in the fourth segment 22*d* is not lower than 20% in the passing time from the second strike.

Since no new strike is performed, as shown in FIG. 9A, the memory content of the peak display information memory 13*a* is the same as the memory content (referring to FIG. 8A) in the second strike. Namely, with respect to the segment number 8, the brightness information (100) and the striking time (ts2), and with respect to the segment number 4, the brightness information (60) and the striking time (ts1) are stored in the peak display information memory 13*a*. As a result, the peak display brightness (%) of the segment 22*h* corresponding to the segment number 8 is determined to be 100×(B2/100)%, the peak display brightness (%) of the segment 22*d* corresponding to the segment number 4 is determined to be 60×(B1/100)%. And the peak display brightness (%) of the segments (22*a* to 22*c*, 22*e* to 22*g*, 22*i*, 22*j*) other than the segments 22*d* and 22*h* is determined to be 0%.

Since the segment number assigned corresponding to the range including 16384 which is the current value of the level counter 13*b* at that timing is 5, the segments 22*a* to 22*e* corresponding to the segment numbers 1 to 5 are determined to be the segments to be used in the bar graph display. As a result, as shown in FIG. 9B, the bar graph display brightness corresponding to those segments 22*a* to 22*e* is determined to be 20%. On the other hand, the bar graph display brightness of the segments 22*f* to 22*j* is determined to be 0%.

As shown in FIG. 9C, the output brightness of the segments 22*a* to 22*c* and 22*e*, in which the peak display brightness is 0% and the bar graph display brightness is 20%, is determined to be 20%. The output brightness of the segment 22*d*, in which the peak display brightness is 60×(B1/100)% and the bar graph display brightness is 20%, is set to be the higher brightness among the peak display brightness and the bar graph display brightness. However, in this example, since it is assumed that the peak display brightness in the fourth segment 22*d* is not lower than 20%, the segment 22*d* is illuminated at the brightness of 60×(B1/100)%. The output brightness of the segment 22*h*, in which the peak display brightness is 100×(B2/100)% and the bar graph display brightness is 0%, is determined to be 100×(B2/100)%. Since the peak display brightness and the bar graph display brightness of the segments 22*f*, 22*g*, 22*i* and 22*j* are 0%, the output brightness of those segments 22*f*, 22*g*, 22*i* and 22*j* is 0%. Moreover, since the values of B1 and B2 are decreased with the passing time, the brightness of the segments 22*d* and 22*h* shown in FIG. 9C (i.e., the output brightness after the predetermined time from the second strike) is correspondingly lower than the brightness of the segments 22*d* and 22*h* shown in FIG. 8C.

As a result, since the value of the level counter 13*b* is decreased with the passing time from the second strike, the length of the bar graph (the display range of the bar graph) is gradually shortened. On the other hand, the peak display of the fourth and eighth segments is remained to be the peak hold even after the strike.

As mentioned above, according to the sound source device 1 (the display control apparatus 100) of the embodiment, every time when the pads 51 to 53 are struck, the segment corresponding to the peak of the level of the striking strength based on the latest strike is illuminated at a highest brightness, and the brightness of the segments corresponding to the peak of the level of the striking strength based on the previous strike is reduced. Accordingly, since the peak of various levels based on a plurality of strikes can be displayed in the level meter 22 with different brightness, it is possible to recognize various levels based on the plurality of strikes. Moreover, at this time, since any of the levels is emitting with different brightness (i.e., not turned off), the level based on the plurality of strikes can be appropriately displayed without the decrease of level display sensation.

Furthermore, though the above embodiments only describe the level based on the pad strikes, for example, when noise is input to the sound source device 1, since the peak of the small level in the level meter 22 is illuminated at the highest brightness, it is also useful in the detection of noise.

Moreover, since the peak display brightness varies with the temporal sequence of the strike, the user can distinguish the temporal sequence of various levels based on the plurality of strikes by the difference of brightness. Furthermore, since the peak display brightness is the maximum brightness with respect to the latest strike and becomes a lower brightness along with being a previous strike, it is easy to recognize the temporal sequence of the level.

In addition, since the peak display brightness gradually decreases along with the passing time from the time being struck, the peak display can be fade out and disappear without a sense of discomfort.

Moreover, since the bar graph display is also gradually shortened along with the passing time from the time being struck, the decay manner of the signal (musical sound) generated based on the latest strike can be displayed and the level display sensation can be improved. At this time, since the brightness of the display of the bar graph compared to the brightness of the peak display during the strike is a lower brightness, the decay manner of the signal can also be informed secondarily.

As mentioned above, though the present invention is described based on the embodiments, various modifications and variations can be made to the structure of the present invention without departing from the scope or spirit of the invention.

For example, the numbers listed in the aforementioned embodiments are just examples and it is possible to adopt any other number.

Moreover, in the abovementioned embodiments, every time when the pads are struck, the brightness of the segment corresponding to the peak of the level based on the previous strike thereof is decreased. Alternatively, every time when the pads are struck, the display manner of the segment corresponding to the peak of the level based on the previous strike thereof can also be different than the display manner of the segment corresponding to the peak of the level based on the current strike. If such a configuration is adopted, similar to the abovementioned embodiment, along with the various levels based on the plurality of strikes being simultaneously displayed in the level meter 22, it becomes possible to distinguish the various levels simultaneously displayed. For instance, multicolor LED such as three-color LEDs can be used as the LED included in each of the first to tenth segments 22*a* to 22*j*. Every time when the pads are struck, the color of the segment corresponding to the peak of the level based on the previous strike can also be set to be different than the color of the segment corresponding to the peak of the level based on the current strike (latest strike). Or, the plurality of display manners, for example, the combination of brightness, color and the like, can also be different.

Furthermore, in the abovementioned embodiments, every time when the pads are struck, the brightness of the segment corresponding to the peak of the level based on the previous strike is decreased. Alternatively, every time when the pads are struck, the brightness of the segment corresponding to the peak of the level based on the previous strike can also be increased.

Additionally, in the aforementioned embodiments, the level meter is described as the level meter 22 for displaying the level by using LEDs. Alternatively, in the other embodiments, a level meter in which graphic is displayed on the display screen such as LCD can be used. In the case that the level meter in which graphic is displayed on display screen is adopted, by changing the size, shape, color or the like of the graphic that displays the peak of the level, it is also possible to distinguish the temporal sequence of various levels based on the plurality of strikes. For instance, the shape of the graphic can be changed in the following ways: when the pads are struck, the graphic corresponding to the peak of the level of the striking strength is designed to be a square, and every time after the pad is struck, the four corners of the square are gradually rounded.

Furthermore, in the abovementioned embodiments, the peak display brightness is decreased according to the passing time from the time being struck. As mentioned above, in the case that every time when the pads are struck, the display manner of the segment corresponding to the peak of the level based on the previous strike is changed, the display manner of the segment can also be changed according to the passing time from the time being struck. In this case, the display manner which changes at every time when the pads are struck and the display manner which changes according to the passing time can be different. For example, the color of the emitting light of the LED can be changed at every time when the pads are struck, and the brightness can also be reduced according to the passing time. Or, in the level meter in which the graphic is displayed on the display screen such as LCD at every time when the pads are struck, the shape of the graphic can be changed at every time when the pads are struck, and the filled up color of the graphic can be gradually changed according to the passing time.

Moreover, in the abovementioned embodiments, the level meter 22 in which the segments 22*a* to 22*j* are arranged in a line, is shown as an example. Alternatively, the segments of the level meter can be arranged in a predetermined order corresponding to the level of the signal, but the shape of the arrangement is not limited thereto. For example, a plurality of segments can be arranged in various shapes such as wavy lines, circular, arc-shaped, spiral, stepwise, and so on. Furthermore, in the above-mentioned embodiments, the level meter 22 in which the segments 22*a* to 22*j* are continuously arranged in a line, is shown as an example. Alternatively, the segments of the level meter can be arranged in a predetermined order corresponding to the level of the signal, the various segments can also be separately arranged (i.e., in a shape of dashed line). In addition, in the abovementioned embodiments, one level range is associated with one segment. Alternatively, one level range can also be associated with a plurality of segments. As a result, for instance, the level meter, in which the locations of the illuminated segments may spread concentrically or in the shape of a sector according to the increase of the level of the signal, can also be used.

Moreover, in the abovementioned embodiments, the level meter 22 in which the level based on the strike of the pads can be displayed is illustrated. Alternatively, the present invention can be also applied in the operators, such as keyboards, pedals or the like, which are capable to detect the operating intensity or the operating speed. For instance, similar to the abovementioned embodiments, the operating intensity or the operating speed detected when a key of the keyboard is pressed can be displayed in the level meter 22.

In addition, in the abovementioned embodiments, it is exemplarily illustrated that the level based on the strike of the pads is displayed in the level meter 22. Alternatively, the present invention is also applicable in audio signals. For example, the steep rise of the audio signal and the part of the rapid change of the envelope can be detected as the peak, the brightness of the segment corresponding to the level of the detected peak can be set to be 100%, the brightness of the segment corresponding to the level of the previous detected peak can be set to decrease.

Additionally, in the abovementioned embodiments, in the step S502, whether the segment is emitting at the brightness wherein the value of the brightness information is equal to or greater than 50 is determined. Alternatively, without providing the condition of the value of the brightness information, it can just determine whether the segment which is emitting exists. Namely, every time when the pads are struck, the brightness of all the segments which are emitting based on the previous strike can be decreased.

Moreover, in the abovementioned embodiments, the change of the value of the brightness information when there is the latest strike is set to be a three-stage change: 100 to 60, 60 to 50 and 50 to 40. Alternatively, it can also set at least one-stage change, for example, two-stage change or more than four-stage change.

Furthermore, in the LED display update process shown in the above-mentioned embodiments, with respect to various segments, the output brightness is set according to whether the segment is the segment to use in the peak display or the segment is the segment to use in the bar graph display. Alternatively, for each of the segments, first comparing the peak display brightness to the bar graph display brightness, and the output brightness can be set to be the higher brightness.

Moreover, in the abovementioned embodiments, with the peak display based on the strike, the bar graph display is displayed in the level meter 22. Alternatively, it can be configured not to perform the bar graph display. In such case, the display colors of the various segments 22*a* to 22*j* from the first segment 22*a* to the tenth segment 22*j* can be a gradation, so that the user can easily recognize the level of the strike.

Moreover, in the abovementioned embodiments, the reduction of the peak display brightness is dependent also on the passing time from the time being struck. Alternatively, it can be configured not to perform the reduction of the peak display brightness with the passing time. Namely, the peak display brightness only decreases when there is the latest strike and automatically becomes 0% after a predetermined time. Or, regardless of the passing time from the time being struck, when there is the latest strike, the brightness of the peak display based on that latest strike and the strike before a predetermined number of strikes (e.g., three strikes) is set to be 0%. In such case, for instance, instead of the striking time, by storing the information capable of recognizing the striking order in the peak display information memory 13*a*, the number of times of the strike with respect to the various segments can also be counted.

In addition, in the abovementioned embodiments, though the display of the level based on the strike is completed, the memory content stored in the peak display information memory 13*a* corresponding to that display is not cleared. Alternatively, in the case that the display of the level based on the strike is completed (namely, in the case that the brightness becomes 0%), the corresponding brightness information and the striking time can be cleared from the peak display information memory 13*a*.

Moreover, in the abovementioned embodiments, the brightness reduction function (FIG. 3C) is illustrated as a linear function. Alternatively, if the brightness finally becomes zero after the predetermined time from the time being struck, the brightness reduction function is not particularly limited, and the brightness reduction function may be a curve function. Or, the brightness reduction function can be a function in which the brightness remains a constant value 100 until the time t1 after striking and monotonously decreases after the time t1. If the brightness after the start of a strike is set to be constant for a while, the brightness right after the strike may be held during the time period. As a result, the discrimination of the user can be enhanced.

In addition, in the abovementioned embodiments, one kind of the brightness reduction function is used. Alternatively, a plurality of kinds of the brightness reduction function can be prepared, and the brightness reduction functions corresponding to the values of the brightness information stored in the peak display information memory 13*a* and the locations of segments to perform peak display can be properly used.

Furthermore, in the abovementioned embodiments, one level meter 22 with respect to the plurality of pads 51 to 53 is included. Alternatively, with respect to the each of the plurality of pads 51 to 53, one level meter 22 can be provided. In that case, each of the level meters is controlled by the display control apparatus 100 corresponding to each of the level meters, respectively. In addition, in the abovementioned embodiments, the display control apparatus 100 is mounted on the sound source device 1. Alternatively, the display control apparatus 100 and the level meter 22 can be configured in a body which is separate from the sound source device. Moreover, the display control apparatus 100 and the level meter 22 can be configured in separate bodies.

In the abovementioned embodiments, the peak display position obtaining unit is exemplarily illustrated in the step S504, and the first peak display control unit is exemplarily illustrated in the step S508. Moreover, the second peak display control unit is exemplarily illustrated in the step S508. In addition, the third peak display control unit is exemplarily illustrated in the step S522. The passing time obtaining unit is exemplarily illustrated in the step S602. And the first level display range determining unit is exemplarily illustrated in the steps S507 and S601. The second level display range determining unit is exemplarily illustrated in the steps S521 and S601. The level display control unit is exemplarily illustrated in the steps S606 and S610.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display control apparatus to control a level display device, the level display device comprising a plurality of display positions arranged in a predetermined order corresponding to increasing signal levels, the display control apparatus comprising:

a level obtaining unit obtaining a level of a signal;

a peak display position obtaining unit obtaining a display position among the plurality of display positions to perform a peak display for displaying a peak of the signal according to the level obtained by the level obtaining unit;

a first peak display control unit displaying the peak display in a predetermined display manner in the display position obtained by the peak display position obtaining unit when the level of the signal is obtained by the level obtaining unit; and a second peak display control unit, when a new peak display position based on a new level of the signal is obtained while a previous peak display with respect to a level of signal obtained at a previous time by the level obtaining unit is being displayed in the display positions, continuing the previous peak display and changing a display manner of the previous peak display being displayed while displaying a new peak display at the new peak display position.

2. The display control apparatus according to claim 1, further comprising a passing time obtaining unit obtaining a passing time period counted from a time when the level of the signal is obtained by the level obtaining unit; and a third peak display control unit, at a predetermined time corresponding to the passing time period counted from the time when the level of the signal is obtained by the level obtaining unit while the peak display is displayed in the display position, changing a display manner of the peak display being displayed according to the passing time period obtained by the passing time obtaining unit.

3. The display control apparatus according to claim 2, further comprising a first level display range determining unit, when the level of the signal is obtained by the level obtaining unit, determining a first display range comprising one or more display positions of the plurality of display positions corresponding to the level obtained by the level obtaining unit;

a second level display range determining unit, determining a second display range by changing the first display range, determined by the first level display range determining unit, to a smaller level as time passes by; and a level display control unit, in the display position included in the display range determined by the first level display range determining unit or the second level display range determining unit, displaying a level display for displaying a level of the signal in a display manner different from the display manner of the peak display.

4. The display control apparatus according to claim 3, wherein the display manner of the previous peak display is a display brightness of the previous peak display and the display manner of the level display is a display brightness of the level display, and a change of the display manner of the previous peak display being displayed is a decrease of the display brightness of the previous peak display.

5. The display control apparatus according to claim 4, wherein the level display control unit sets the display brightness of the level display assigned according to the display position included in the display range determined by the first level display range determining unit or the second level display range determining unit, the display brightness of the level display is set to be a predetermined brightness which is smaller than at least the display brightness when the peak display is initiated by the first peak display control unit, and the level display control unit displays, at the brightness of the level display, the display position included in the display range with the brightness of the peak display controlled by the first, the second or the third peak display control unit which is lower than the brightness of the level display, or the display position included in the display range at which the peak display is not performed by the first, the second or the third peak display control unit.

6. The display control apparatus according to claim 2, wherein the display manner of the previous peak display is a display brightness of the previous peak display and the display manner of the level display is a display brightness of the level display, and a change of the display manner of the previous peak display being displayed is a decrease of the display brightness of the previous peak display.

7. The display control apparatus according to claim 6, wherein the level display control unit sets the display brightness of the level display assigned according to the display position included in the display range determined by the first level display range determining unit or the second level display range determining unit, the display brightness of the level display is set to be a predetermined brightness which is smaller than at least the display brightness when the peak display is initiated by the first peak display control unit, and the level display control unit displays, at the brightness of the level display, the display position included in the display range with the brightness of the peak display controlled by the first, the second or the third peak display control unit which is lower than the brightness of the level display, or the display position included in the display range at which the peak display is not performed by the first, the second or the third peak display control unit.

8. The display control apparatus according to claim 2, wherein the level obtaining unit obtains the level of the signal which is input by striking a striking head.

9. The display control apparatus according to claim 2, wherein the level obtaining unit obtains the level of the signal which is input by striking a plurality of striking heads.

10. The display control apparatus according to claim 1, further comprising a first level display range determining unit, when the level of the signal is obtained by the level obtaining unit, determining a first display range comprising one or more display positions of the plurality of display positions corresponding to the level obtained by the level obtaining unit;

a second level display range determining unit, determining a second display range by changing the first display range, determined by the first level display range determining unit, to a smaller level as time passes by; and a level display control unit, in the display position included in the display range determined by the first level display range determining unit or the second level display range determining unit, displaying a level display for displaying a level of the signal in a display manner different from the display manner of the peak display.

11. The display control apparatus according to claim 10, wherein the display manner of the previous peak display is a display brightness of the previous peak display and the display manner of the level display is a display brightness of the level display, and a change of the display manner of the previous peak display being displayed is a decrease of the display brightness of the previous peak display.

12. The display control apparatus according to claim 11, wherein the level display control unit sets the display brightness of the level display assigned according to the display position included in the display range determined by the first level display range determining unit or the second level display range determining unit, the display brightness of the level display is set to be a predetermined brightness which is smaller than at least the display brightness when the peak display is initiated by the first peak display control unit, and the level display control unit displays, at the brightness of the level display, the display position included in the display range with the brightness of the peak display controlled by the first, the second or the third peak display control unit which is lower than the brightness of the level display, or the display position included in the display range at which the peak display is not performed by the first, the second or the third peak display control unit.

13. The display control apparatus according to claim 10, wherein the level obtaining unit obtains the level of the signal which is input by striking a striking head.

14. The display control apparatus according to claim 10, wherein the level obtaining unit obtains the level of the signal which is input by striking a plurality of striking heads.

15. The display control apparatus according to claim 1, wherein the display manner of the previous peak display is a display brightness of the previous peak display and the display manner of the level display is a display brightness of the level display, and a change of the display manner of the previous peak display being displayed is a decrease of the display brightness of the previous peak display.

16. The display control apparatus according to claim 15, wherein the level display control unit sets the display brightness of the level display assigned according to the display position included in the display range determined by the first level display range determining unit or the second level display range determining unit, the display brightness of the level display is set to be a predetermined brightness which is smaller than at least the display brightness when the peak display is initiated by the first peak display control unit, and the level display control unit displays, at the brightness of the level display, the display position included in the display range with the brightness of the peak display controlled by the first, the second or the third peak display control unit which is lower than the brightness of the level display, or the display position included in the display range at which the peak display is not performed by the first, the second or the third peak display control unit.

17. The display control apparatus according to claim 15, wherein the level obtaining unit obtains the level of the signal which is input by striking a striking head.

18. The display control apparatus according to claim 15, wherein the level obtaining unit obtains the level of the signal which is input by striking a plurality of striking heads.

19. The display control apparatus according to claim 1, wherein the level obtaining unit obtains the level of the signal which is input by striking a striking head.

20. The display control apparatus according to claim 1, wherein the level obtaining unit obtains the level of the signal which is input by striking a plurality of striking heads.

* * * * *